US009435247B2

(12) United States Patent
Sakai et al.

(10) Patent No.: US 9,435,247 B2
(45) Date of Patent: Sep. 6, 2016

(54) EXHAUST PIPE STRUCTURE OF MOTORCYCLE

(71) Applicant: HONDA MOTOR CO., LTD., Tokyo (JP)

(72) Inventors: Takeshi Sakai, Wako (JP); Satoshi Matsushima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/659,096

(22) Filed: Mar. 16, 2015

(65) Prior Publication Data

US 2015/0267592 A1 Sep. 24, 2015

(30) Foreign Application Priority Data

Mar. 20, 2014 (JP) ..... 2014-057513

(51) Int. Cl.

| | |
|---|---|
| ***F01N 13/00*** | (2010.01) |
| ***F01N 13/08*** | (2010.01) |
| ***F01N 13/18*** | (2010.01) |
| *F02B 61/02* | (2006.01) |

(52) U.S. Cl.

CPC ..... *F01N 13/002* (2013.01); *F01N 13/08* (2013.01); *F01N 13/1805* (2013.01); *F01N 2340/04* (2013.01); *F01N 2590/04* (2013.01); *F02B 61/02* (2013.01)

(58) Field of Classification Search

CPC .. F01N 13/002; F01N 13/1805; F01N 13/08; F01N 2340/04; F01N 2590/04; F02B 61/02

See application file for complete search history.

(56) References Cited

U.S. PATENT DOCUMENTS

2005/0236205 A1* 10/2005 Konno ..... B62M 7/02 180/219
2010/0101886 A1* 4/2010 Ishibe ..... B62K 25/283 180/296
2011/0186373 A1* 8/2011 Mori ..... F01N 13/08 180/219

FOREIGN PATENT DOCUMENTS

JP 2010-100224 A 5/2010

* cited by examiner

*Primary Examiner* — Audrey K Bradley

(74) *Attorney, Agent, or Firm* — Birch, Stewart, Kolasch & Birch, LLP

(57) ABSTRACT

An exhaust pipe structure of a motorcycle allowing exhaust air of an exhaust pipe having a branching part to flow into the respective exhaust pipes on the downstream side of the branching part uniformly and smoothly. In an exhaust pipe structure of a motorcycle having an engine attached to a vehicle body frame, an exhaust pipe is connected to an exhaust port of the engine and is provided with a branching pipe that branches into a left-rear-portion exhaust pipe and a right-rear-portion exhaust pipe. A muffler is connected to the left-rear-portion exhaust pipe. A muffler is connected to the right-rear-portion exhaust pipe. The branching pipe is located on a lateral side of a cylinder unit of the engine and above a crankcase cover.

16 Claims, 7 Drawing Sheets

EXHAUST PIPE STRUCTURE OF MOTORCYCLE

CROSS-REFERENCE TO RELATED APPLICATIONS

The present application claims priority under 35 USC 119 to Japanese Patent Application No. 2014-057513 filed Mar. 20, 2014 the entire contents of which are hereby incorporated by reference.

BACKGROUND OF THE INVENTION

1. Field of the Invention

The present invention relates to an exhaust pipe structure for a motorcycle wherein an exhaust pipe branches halfway.

2. Description of Background Art

A structure is known wherein an exhaust pipe, connected to an exhaust port of an internal combustion engine, is made to branch halfway and be connected to left and right mufflers. See, for example, Japanese Patent Laid-Open No. 2010-100224.

In Japanese Patent Laid-Open No. 2010-100224, the branching part of the exhaust pipe is provided on the rear side relative to a cylinder head of the internal combustion engine. Furthermore, on the immediate downstream side of the branching part, one exhaust pipe drastically curves in such a manner so as to avoid a rear shock absorber unit. In addition, the other exhaust pipe extends substantially on an extension of the exhaust pipe on the upstream side of the branching part. Therefore, in the one exhaust pipe, the exhaust flow is biased toward the outer circumferential side in the pipe and the airflow resistance increases, which suppresses the passing of the exhaust air. Accordingly, there is a problem that most of the exhaust air before the branching flows into the other exhaust pipe.

SUMMARY AND OBJECTS OF THE INVENTION

An object of an embodiment of the present invention is to provide an exhaust pipe structure of a motorcycle for allowing exhaust air of an exhaust pipe having a branching part to flow into the respective exhaust pipes on the downstream side of the branching part uniformly and smoothly.

In order to solve the above-described problem, according to an embodiment of the present invention, an exhaust pipe structure of a motorcycle having an internal combustion engine (14) is attached to a vehicle body frame (11). An exhaust pipe (51) is connected to an exhaust port (14*a*) of the internal combustion engine (14) and is provided with a branching part (74) that branches into two branch exhaust pipes (76, 77), and mufflers (52) each connected to a respective one of the branch exhaust pipes (76, 77). The exhaust pipe structure of a motorcycle according to an embodiment of the present invention includes the branching part (74) that is located on a lateral side of a cylinder unit (44) of the internal combustion engine (14) and above a crankcase cover (65).

In the above configuration, the branching part (74) may branch in such a manner that the two branch exhaust pipes (76, 77) are juxtaposed substantially in an upward-downward direction.

Furthermore, in the above configuration, the exhaust pipe (51) may extend from the exhaust port (14*a*) toward a front side and then curve rearwardly at a curving part (73*b*) and branch from the branching part (74) at a part further extending rearwardly. Furthermore, a section of the branching part (74) may be formed into a substantially elongated circular shape and a long axis (151) of the elongated circular shape may incline to be substantially parallel to a tangent plane (143) to a curving outer circumferential line (73*e*) passing on an outermost circumference of the curving part (73*b*) of the exhaust pipe (51).

Furthermore, in the above configuration, one of the branch exhaust pipes (76, 77) may pass between a pivot plate (23) and a rear shock absorber (91) to extend rearwardly and be connected to one of the mufflers (52), and an other of the branch exhaust pipes (76, 77) may pass between a rear side of the cylinder unit (44) and a front side of the rear shock absorber (91) and then pass between an other pivot plate (23) and the rear shock absorber (91) to extend rearwardly and be connected to an other of the mufflers (52).

In addition, in the above configuration, the branch exhaust pipes (76, 77) may have at least one bending part (76*b*, 76*d*, 77*b*) in a space that is on the rear side of the cylinder unit (44), on the front side of the rear shock absorber (91), above a crankcase (43), and below an intake system (47).

Moreover, in the above configuration, the branching part (74) and parts connected to front and rear of the branching part (74) in the exhaust pipe (51) may be formed into a linear part (93) having a linear shape and this linear part (93) may extend along an upper surface (65*a*) of the crankcase cover (65) in side view.

According to an embodiment of the present invention, the branching part is located on a lateral side of the cylinder unit of the internal combustion engine and above the crankcase cover. Therefore, the branching part can be disposed closer to the vehicle body front side and near the center of the vehicle body. This can reduce the degree of bending of the branch exhaust pipes after the branching, which can provide a structure that reduces the airflow resistance to improve the passing of the exhaust air and makes the exhaust air flow into the respective branch exhaust pipes more uniformly. Accordingly, the exhaust air can be made to flow into the respective branch exhaust pipes more uniformly and smoothly.

Furthermore, according to an embodiment of the present invention, the branching part branches in such a manner so that the two branch exhaust pipes are juxtaposed substantially in the upward-downward direction. Thus, the branching part can be housed in a dead space on a lateral side of the cylinder unit and above the crankcase cover. This can reduce the degree of protrusion of the branching part in the vehicle width direction.

In addition, according to an embodiment of the present invention, the exhaust pipe extends from the exhaust port toward the front side and then curves rearwardly at the curving part and branches from the branching part at a part further extending rearwardly. Furthermore, a section of the branching part is formed into a substantially elongated circular shape and the long axis of the elongated circular shape inclines to be substantially parallel to the tangent plane to the curving outer circumferential line passing on the outermost circumference of the curving part of the exhaust pipe. Thus, the exhaust air flows with a bias toward the curving outer circumferential line. Therefore, by setting the long axis of the branching part substantially parallel to the tangent plane to the curving outer circumferential line, a flow conditioning effect can be achieved in the branching part and the exhaust air can be sent from the branching part to the two branch exhaust pipes more uniformly.

Moreover, one of the branch exhaust pipes passes between the pivot plate and the rear shock absorber to extend rearwardly and be connected to one of the mufflers, and the other of the branch exhaust pipes passes between the rear side of the cylinder unit and the front side of the rear shock absorber and then passes between the other pivot plate and the rear shock absorber to extend rearwardly and be connected to the other of the mufflers. Thus, the bending of the branch exhaust pipes can be reduced and these pipes can be made linear. This can reduce the airflow resistance and improve the passing of the exhaust air.

Furthermore, according to an embodiment of the present invention, the branch exhaust pipes have at least one bending part in a space that is on the rear side of the cylinder unit, on the front side of the rear shock absorber, above the crankcase, and below the intake system. Therefore, the length of the exhaust pipe can be adjusted by providing the bending part by utilizing a dead space, and the flexibility in the design of the internal combustion engine can be increased.

In addition, according to an embodiment of the present invention, the branching part and parts connected to the front and rear of the branching part in the exhaust pipe are formed into the linear part having a linear shape and this linear part extends along the upper surface of the crankcase cover in side view. Thus, the length across which air in the exhaust passage is conditioned can be ensured by the linear part and the exhaust air that has passed in the branching pipe can be made to uniformly flow into the two branch exhaust pipes. Furthermore, by disposing the linear part along the upper surface of the crankcase cover, a space above the crankcase cover can be efficiently used.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6(A) is a diagram showing the connection state of the respective parts of the exhaust pipe and FIG. 6(B) is a sectional view along line B-B in FIG. 6(A); FIG. 7(A) is a plan view and FIG. 7(B) is a diagram as viewed from the direction that is orthogonal to a branching pipe center line and is a horizontal direction.

DETAILED DESCRIPTION OF THE PREFERRED EMBODIMENTS

One embodiment of the present invention will be described below with reference to the drawings. In the description, directions such as front, rear, left, right, upward, and downward directions are the same as those with respect to the vehicle body unless particularly stated. Furthermore, as shown in the respective diagrams FR indicates the vehicle body front side. In addition, the vehicle body upper side UP and the vehicle body left side LE are provided.

Figure 1:
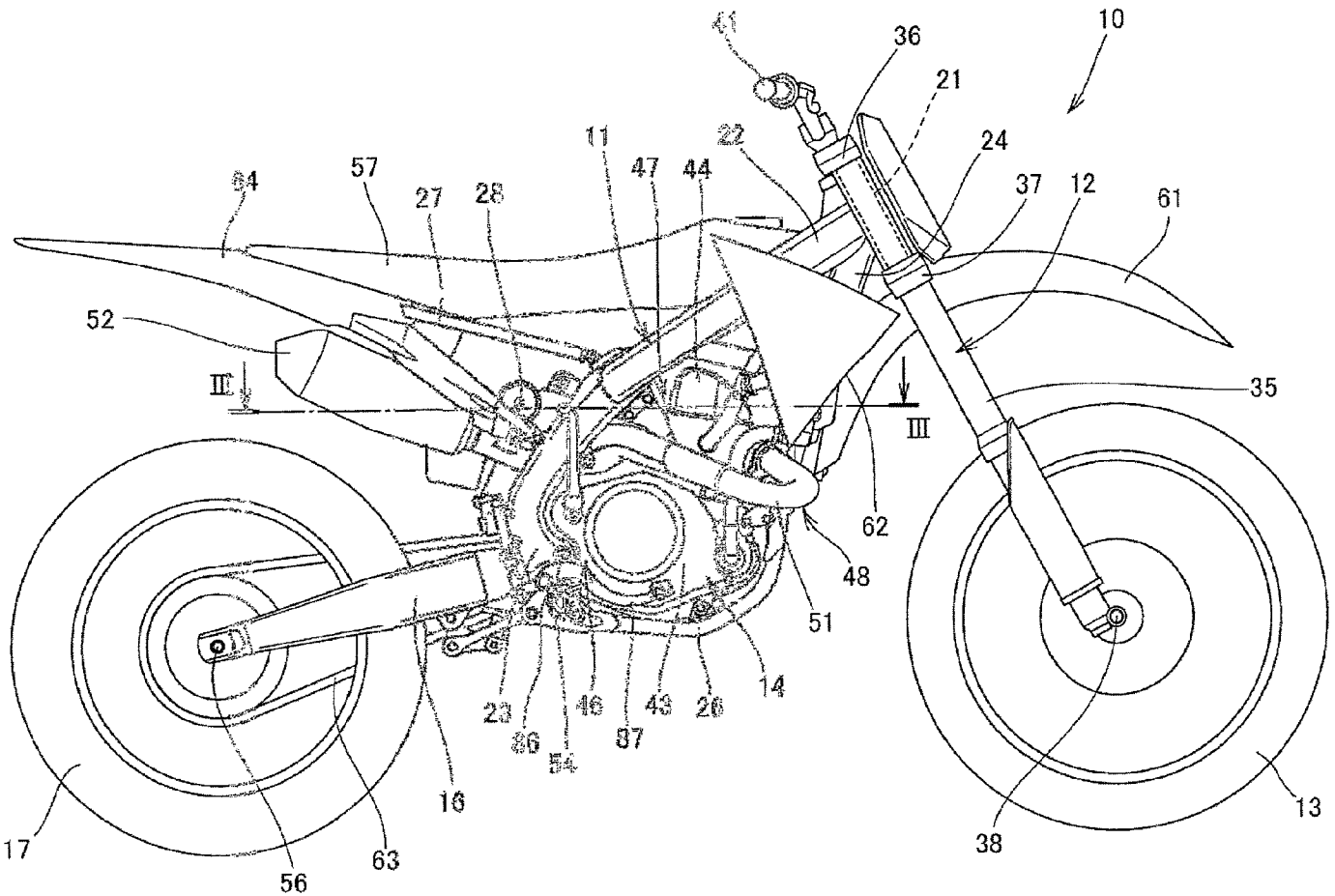
FIG. 1 is a right side view of a motorcycle including an exhaust pipe structure of one embodiment of the present invention.

FIG. 1 is a right side view of a motorcycle 10 including an exhaust pipe structure of one embodiment of the present invention.

The motorcycle 10 is a saddle-type vehicle having the following structure. A front wheel 13 is steerably supported by the front end part of a vehicle body frame 11 with the intermediary of a front fork 12 and an engine 14 being supported by the lower part of the vehicle body frame 11. Furthermore, a rear wheel 17 is supported by the lower rear part of the vehicle body frame 11 with the intermediary of a swing arm 16.

The vehicle body frame 11 includes a head pipe 21, a pair of left and right main frames 22, a pair of left and right pivot plates 23, a down frame 24, a pair of left and right under frames 26, a pair of left and right seat rails 27, and a pair of left and right sub-frames 28.

The head pipe 21 forms the front end part of the vehicle body frame 11. The main frames 22 extend from the head pipe 21 toward the rear side and the obliquely lower side on the left and right sides. The pivot plates 23 extend from the rear end parts of the left and right main frames 22 toward the lower side and the obliquely rear side and then toward the lower side and the obliquely front side. The down frame 24 extends from the attached part of the left and right main frames 22 to the head pipe 21 toward the lower side and the obliquely rear side. The under frames 26 extend from the lower end part of the down frame 24 toward the lower side on the left and right sides and extend rearwardly below the engine 14 to be joined to the pivot plates 23. The seat rails 27 extend from the lower end parts of the main frames 22 toward the rear side and the obliquely upper side and their rear end parts are joined to the rear end parts of the sub-frames 28 extending from the pivot plates 23 toward the rear side and the obliquely upper side.

The front fork 12 is composed of a pair of left and right fork pipes 35, a top bridge 36, a bottom bridge 37, and a steering stem (not shown). The fork pipes 35 are formed of shock absorbers and the front wheel 13 is supported by the lower end parts of the left and right fork pipes 35 with the intermediary of an axle 38. The top bridge 36 and the bottom bridge 37 span the space between the left and right fork pipes 35 and a bar handle 41 is attached to the top bridge 36. The steering stem is rotatably supported by the head pipe 21 and is vertically attached to the center of each of the top bridge 36 and the bottom bridge 37.

The engine 14 is supported by the pivot plates 23, the down frame 24, and the under frames 26 and includes a crankcase 43 and a cylinder unit 44 extending upwardly from the upper front part of the crankcase 43. An engine hanger 45 is attached to the upper end part of the pivot plate 23 in order to support the engine 14.

A transmission 46 is integrally provided to the rear part of the crankcase 43. Intake apparatus 47 is connected to the rear part of the cylinder unit 44 and exhaust apparatus 48 is connected to the front part. The exhaust apparatus 48 includes an exhaust pipe 51 that protrudes from the cylinder unit 44 toward the vehicle body right side to extend rearwardly with curving and branches to extend toward the left and right rear sides. A left and a right muffler 52, respectively, are individually connected to the rear end part of the exhaust pipe 51.

The swing arm 16 is supported vertically swingably by a pivot shaft 54 provided at the lower part of the pivot plate 23. The rear wheel 17 is supported by its rear end part with the intermediary of an axle 56. A seat 57 is supported by the upper parts of the main frames 22 and the seat rails 27. A front fender 61 covers the front wheel 13 from above and a pair of left and right shrouds 62 cover the left and right lateral sides of the front part of the vehicle body frame 11. In addition, a chain 63 transmits power from the transmission 46 to the rear wheel 17. A rear fender 64 covers the rear wheel 17 from above.

Figure 2:
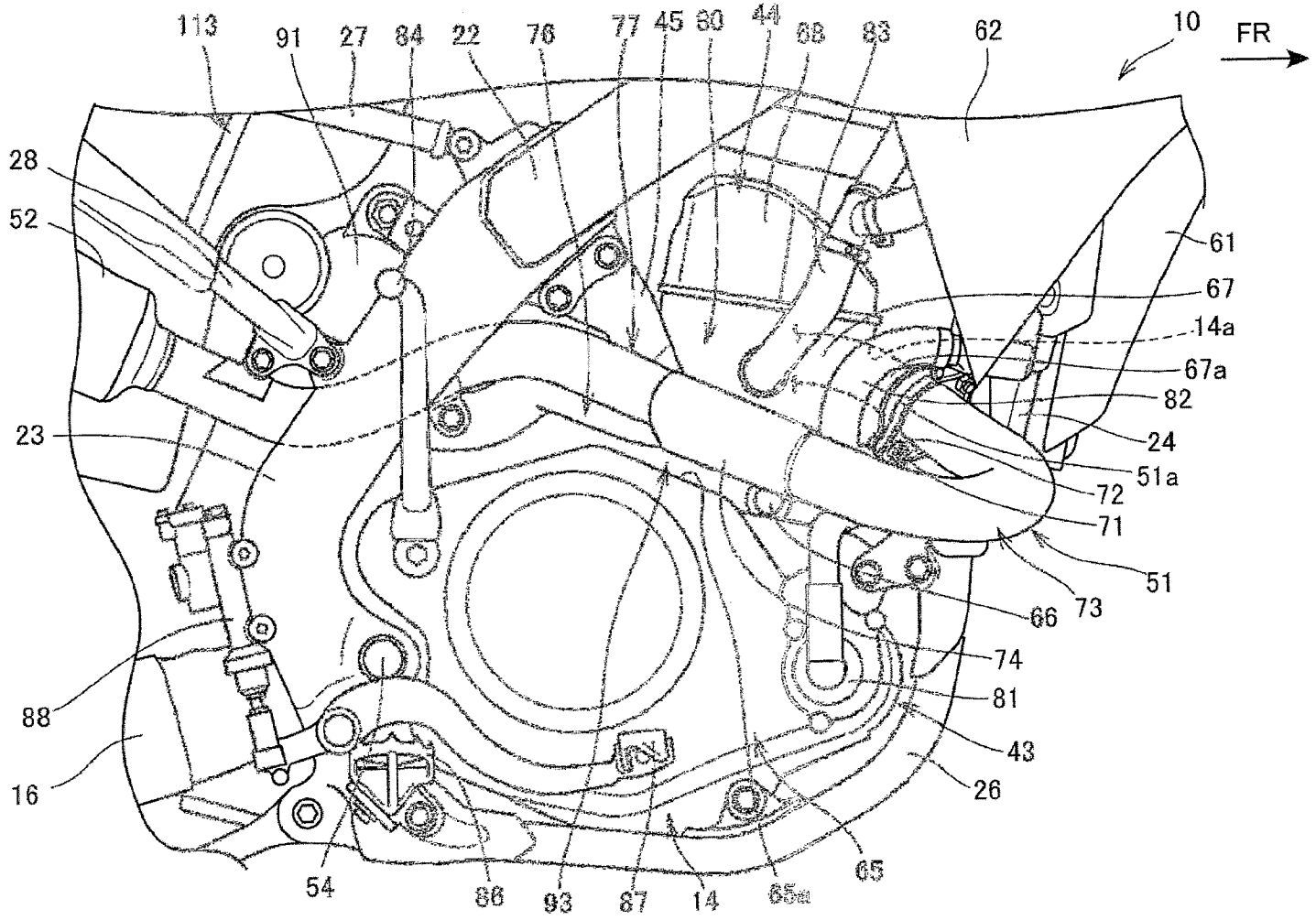
FIG. 2 is a right side view of the major part of the motorcycle for showing the exhaust pipe structure.

FIG. 2 is a right side view of the major part of the motorcycle 10 for showing the exhaust pipe structure.

The crankcase 43 has a crankcase main body (not shown) disposed inside in the vehicle width direction and left and right crankcase covers 65 attached to both side parts of the crankcase main body.

The cylinder unit 44 of the engine 14 includes a cylinder block 66 attached to the upper front part of the crankcase 43, a cylinder head 67 attached to the upper part of the cylinder block 66, and a head cover 68 covering the upper part of the cylinder head 67.

An exhaust pipe connecting part 67*a* is monolithically provided at the front part of the cylinder head 67. The exhaust pipe connecting part 67*a* is a part at which an exhaust port 14*a* communicating with a combustion chamber is opened to the atmosphere. A flange part 51*a*, provided on the exhaust pipe 51, is attached to the exhaust pipe connecting part 67*a* by a pair of bolts 71 and a pair of nuts 72 with the exhaust pipe 51 being connected to the exhaust port 14*a*.

The exhaust pipe 51 is composed of a front-portion exhaust pipe 73 that extends from the exhaust pipe connecting part 67*a* toward the front side and the obliquely right side and then curves rearwardly to further extend toward the rear side and the obliquely vehicle body inside, and two exhaust pipes connected to the front-portion exhaust pipe 73 with the intermediary of a branching pipe 74, i.e. a left-rear-portion exhaust pipe 76 and a right-rear-portion exhaust pipe 77. More specifically, the exhaust pipe 51 is made to branch from one pipe into two pipes by the branching pipe 74 and the left-rear-portion exhaust pipe 76 and the right-rear-portion exhaust pipe 77 are connected to the left and right mufflers 52, respectively.

The branching pipe 74 is disposed close to the outside of the cylinder unit 44, specifically the cylinder block 66 and the cylinder head 67, in the vehicle width direction. Furthermore, the branching pipe 74 is disposed above the right crankcase cover 65. That is, the branching pipe 74 and part of the front-portion exhaust pipe 73, the left-rear-portion exhaust pipe 76, and the right-rear-portion exhaust pipe 77, which are connected to the front and rear of the branching pipe 74, are disposed in a space 80 made on a lateral side of the cylinder unit 44 and above the crankcase cover 65.

The front-portion exhaust pipe 73 extends from the exhaust pipe connecting part 67*a* toward the vehicle body outside with gradual lowering and curves rearwardly to thereafter extend toward the vehicle body inside with rising. The branching pipe 74 is inclined to extend toward the upper rear side in side view. Near the branching pipe 74, the left-rear-portion exhaust pipe 76 and the right-rear-portion exhaust pipe 77 are inclined to extend toward the upper rear side in a side view. After the extension toward the upper rear side, the inclination of the right-rear-portion exhaust pipe 77 is changed and the right-rear-portion exhaust pipe 77 extends toward the lower rear side on the inside of the right pivot plate 23 in the vehicle width direction. Then, the right-rear-portion exhaust pipe 77 is inclined to extend toward the upper rear side again near the part connecting to the muffler 52. The right-rear-portion exhaust pipe 77 is disposed so as to be higher than the left-rear-portion exhaust pipe 76 near the branching pipe 74.

Inside the branching pipe 74 and the right-rear-portion exhaust pipe 77 (more specifically, right-rear-portion front end part 77*a*) in the vehicle width direction, the tip part of the engine hanger 45 and a supported part 67*e* (see FIG. 4) integrally provided on a rear surface 67*d* of the cylinder head 67 in order to support the engine 14 by the engine hanger 45 are disposed. Therefore, the right-rear-portion exhaust pipe 77 passes through the outside of the engine hanger 45 in the vehicle width direction and passes through the inside of the pivot plate 23 in the vehicle width direction.

A water pump 81 is provided at the front part of the crankcase 43 with radiator lines 82 and 83. Furthermore, a kick pedal 84 is provided on the transmission 46. A step 86 is provided for the driver. In addition, a brake pedal 87 is provided with a master cylinder 88 linked to the brake pedal 87.

Figure 3:
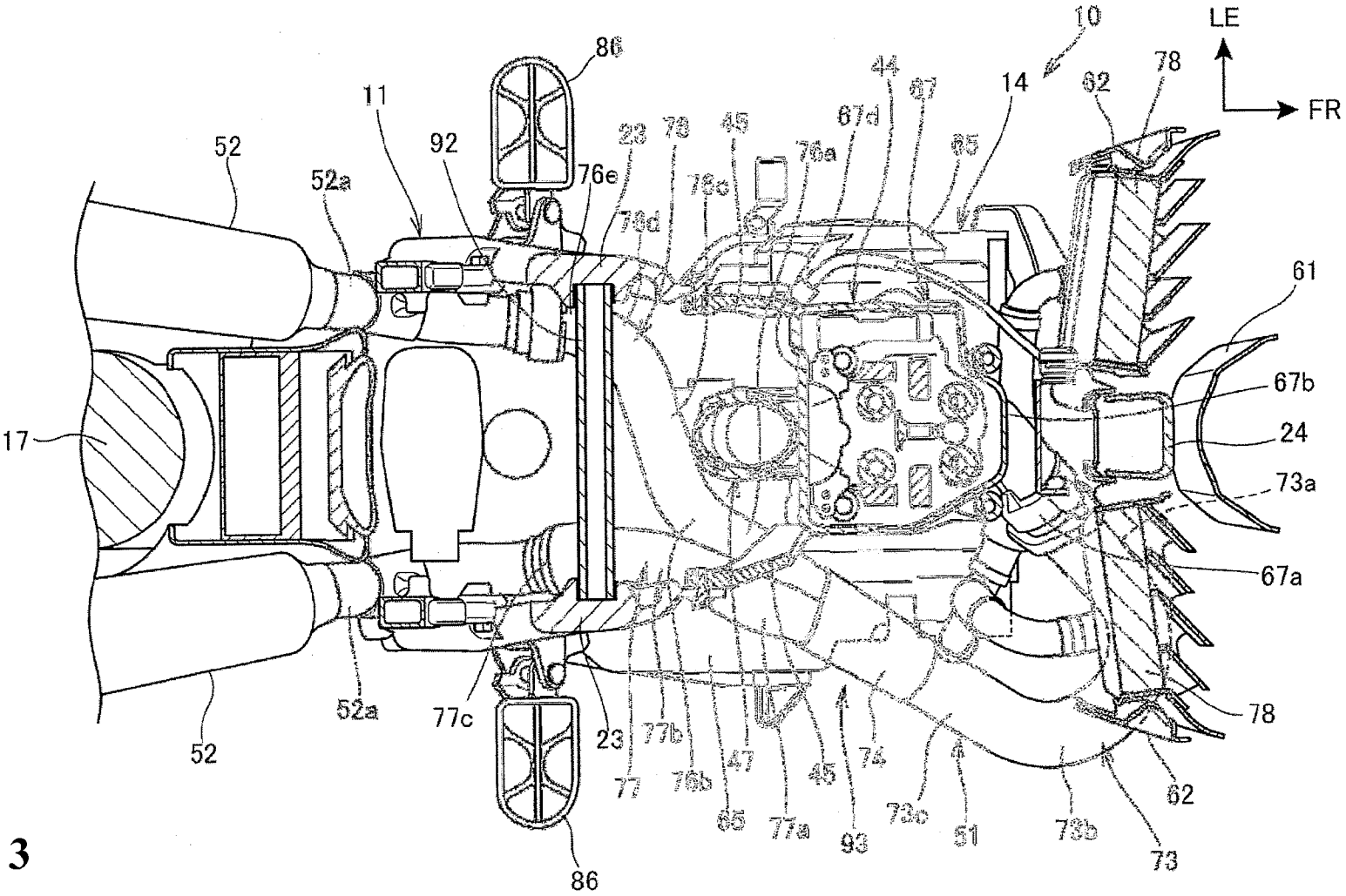
FIG. 3 is a sectional view along line in FIG. 1.

FIG. 3 is a sectional view along line in FIG. 1.

The exhaust pipe connecting part 67*a* is provided on the right side relative to a front surface 67*b* of the cylinder head 67, more specifically relative to the center of the front surface 67*b* in the vehicle width direction.

The front-portion exhaust pipe 73 of the exhaust pipe 51 is monolithically composed of a front-portion front end part 73*a* extending from the exhaust pipe connecting part 67*a* toward the front side and the obliquely vehicle body outside, a front-portion curving part 73*b* that is formed so as to turn rearwardly from the front-portion front end part 73*a*, and a front-portion rear end part 73*c* extending from the rear end of the front-portion curving part 73*b* toward the rear side and the obliquely vehicle body inside. The foremost end part of the front-portion front end part 73*a* is located below a right radiator 78 of a pair of left and right radiators 78 disposed on the outside of the down frame 24 in the vehicle width direction.

The branching pipe 74 extends along the same direction as the front-portion rear end part 73*c* of the front-portion exhaust pipe 73.

The left-rear-portion exhaust pipe 76 is monolithically composed of a left-rear-portion front end part 76*a* extending from the branching pipe 74 toward the rear side and the obliquely left side, a left-rear-portion middle part 76*c* that is connected to the left-rear-portion front end part 76*a* with the intermediary of a first bending part 76*b* and extends toward the left side and the obliquely rear side, and a left-rear-portion extending part 76*e* extending rearwardly from the left-rear-portion middle part 76*c* with the intermediary of a second bending part 76*d*.

The left-rear-portion front end part 76*a* is located below the engine hanger 45. The first bending part 76*b* is located on the right side of the intake apparatus 47 connected to the rear part of the cylinder head 67. The left-rear-portion middle part 76*c* passes in front of a rear shock absorber 91 on the rear side of the intake apparatus 47. The second bending part 76*d* is located at a part overlapping with, in plan view, a pipe-shaped crossing member 92 that joins the left and right pivot plates 23 to each other and extends along the vehicle width direction. The left-rear-portion extending part 76*e* passes between the left pivot plate 23 and the rear shock absorber 91 and is connected to a pipe part 52*a* provided at the front end part of the muffler 52.

The crossing member 92 is disposed on the front side of the left and right steps 86 for the driver closely in the vehicle body front-rear direction.

The right-rear-portion exhaust pipe 77 is monolithically composed of the right-rear-portion front end part 77*a* extending from the branching pipe 74 toward the rear side and the obliquely left side and a right-rear-portion extending part 77*c* that is connected to the right-rear-portion front end part 77*a* with the intermediary of a bending part 77*b* and extends rearwardly. The right-rear-portion front end part 77*a* is located below the attached part of the engine hanger 45 to the right pivot plate 23 and the engine hanger 45. The bending part 77*b* passes inside the right pivot plate 23 in the vehicle width direction. The right-rear-portion extending part 77*c* passes between the right pivot plate 23 and the rear shock absorber 91 and is connected to the pipe part 52*a* of the muffler 52.

In the exhaust pipe 51 of the present embodiment, the front-portion rear end part 73*c* of the front-portion exhaust pipe 73, the branching pipe 74, the left-rear-portion front end part 76*a* of the left-rear-portion exhaust pipe 76, and the right-rear-portion front end part 77*a* of the right-rear-portion exhaust pipe 77 form a linear part 93 having an almost straight line shape as is understood from the side view shown in FIG. 2 and the plan view shown in FIG. 3. The linear part 93 is formed long to extend from the front surface 67*b* of the cylinder head 67 to a part on the rear side relative to the rear surface 67*d* of the cylinder head 67 (part at which the intake apparatus 47 bends upward) in the vehicle front-rear direction.

By forming the linear part 93 including the branching pipe 74 and ensuring the length of the linear part 93 in this manner, a structure providing the following advantages can be obtained. More specifically, the passage resistance can be reduced and the exhaust air flowing in the linear part 93 can be conditioned. Furthermore, it is easy to distribute the exhaust air into the left-rear-portion exhaust pipe 76 and the right-rear-portion exhaust pipe 77 more uniformly. Furthermore, in FIG. 2, the linear part 93 extends toward the upper rear side along an upper surface 65*a* of the crankcase cover 65. Therefore, the linear part 93 can be disposed close to the crankcase cover 65. Accordingly, the space 80 above the crankcase cover 65 can be efficiently used.

Figure 4:
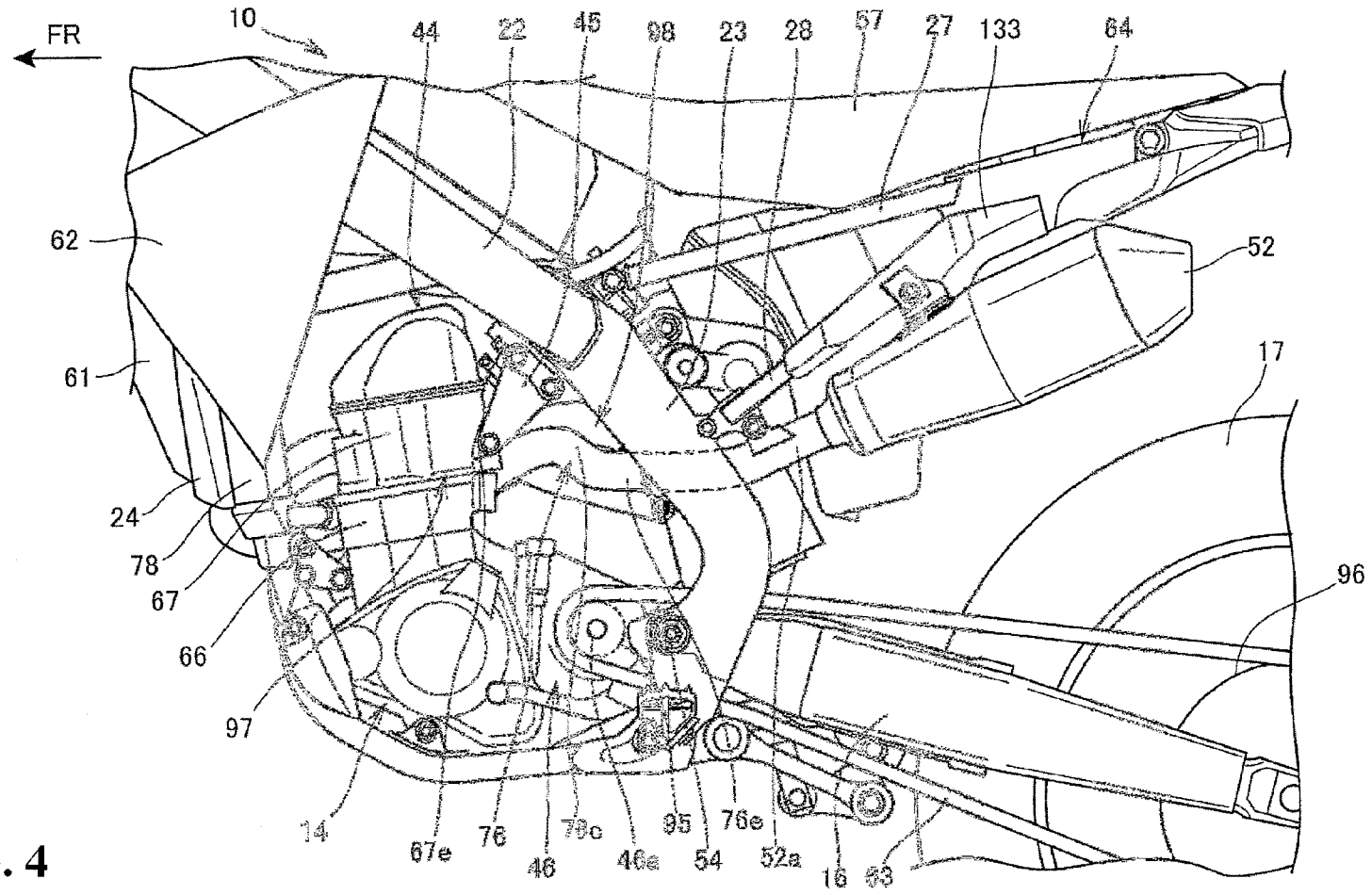
FIG. 4 is a left side view of the major part of the motorcycle for showing the exhaust pipe structure.

FIG. 4 is a left side view of the major part of the motorcycle 10 for showing the exhaust pipe structure.

The left-rear-portion middle part 76*c* of the left-rear-portion exhaust pipe 76 is disposed above the transmission 46 in a side view, more specifically for example above an output shaft 46*a* of the transmission 46 and a drive sprocket 95 attached to the output shaft 46*a* in a side view.

The chain 63 is wound around the drive sprocket 95 together with a driven sprocket 96 provided integrally with the rear wheel 17 and power is transmitted from the drive sprocket 95 to the rear wheel 17 via the chain 63 and the driven sprocket 96.

Furthermore, the left-rear-portion middle part 76*c* is disposed rearwardly of a joining part 97 between the cylinder block 66 and the cylinder head 67 in a side view. In this manner, the left-rear-portion middle part 76*c* as part of the left-rear-portion exhaust pipe 76 is disposed in a space 98 made above the transmission 46 provided to the rear part of the engine 14 and on the rear side of the cylinder unit 44. The space 98 is surrounded by the engine 14, the main frame 22, and the pivot plate 23 in side view.

The left-rear-portion extending part 76*e* of the left-rear-portion exhaust pipe 76 and the pipe part 52*a* of the muffler 52 curve with such a large radius of curvature as to be downwardly convex from the side of the left-rear-portion middle part 76*c*. Therefore, the airflow resistance can be further reduced while the muffler 52 is disposed to extend toward the upper rear side.

Figure 5:
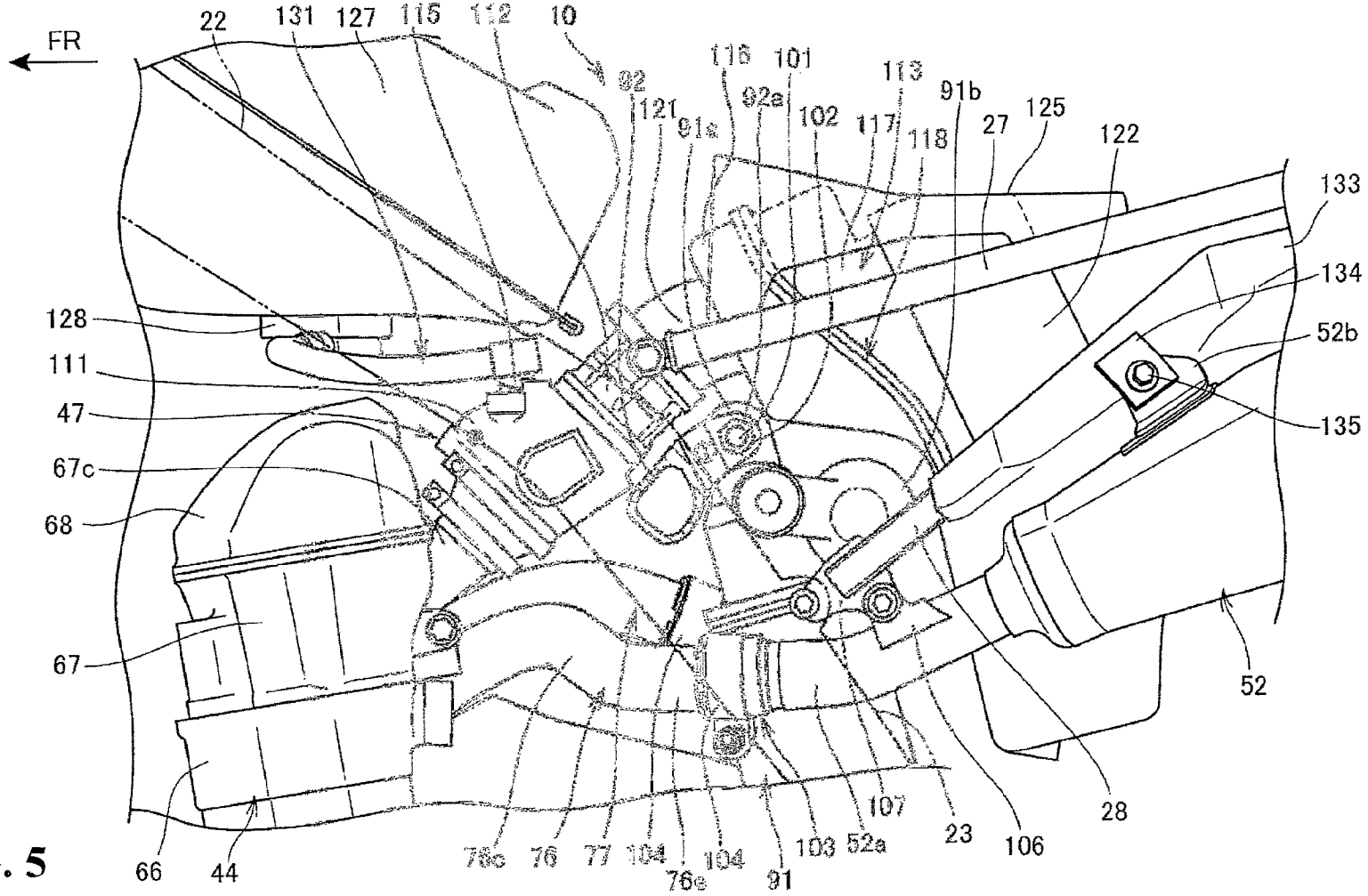
FIG. 5 is a left side view showing the major part of the motorcycle wherein a vehicle body frame is omitted.

FIG. 5 is a left side view showing the major part of the motorcycle 10 wherein the vehicle body frame is omitted.

The rear shock absorber 91 extends substantially along the upward-downward direction and its upper end part 91*a* is attached, by a bolt 101 and a nut 102, to an upper shock absorber support part 92*a* protruding toward the upper side and the obliquely rear side from the center part of the crossing member 92, which spans the space between the left and right pivot plates 23, in the vehicle width direction. An oil reservoir tank 91*b* is integrally provided at the upper rear part of the rear shock absorber 91 and part of oil flowing in the rear shock absorber 91 is retained therein.

A rear-portion connecting part 103 that connects the left-rear-portion extending part 76*e* of the left-rear-portion exhaust pipe 76 to the pipe part 52*a* of the muffler 52 is provided on the left side of the rear shock absorber 91. The rear-portion connecting part 103 is a part at which the rear end part of the left-rear-portion extending part 76*e* is fitted to the front end part of the pipe part 52*a*, and is tightened by a band member 104.

A bracket 106 is attached to the upper part of the intermediate part of the pipe part 52*a*. A front end joint part 107 joined to the pivot plate 23 is provided at the front end part of the sub-frame 28 and the pipe part 52*a* is attached to the front end joint part 107 with the intermediary of the bracket 106.

The intake apparatus 47 includes an intake pipe 67*c* provided integrally with the rear part of the cylinder head 67, a throttle body 111 connected to the intake pipe 67*c*, and an air cleaner 113 connected to the rear end part of the throttle body 111 with the intermediary of a connecting tube 112. As shown in the diagram, the intake apparatus 47 extends from the cylinder head 67 with such an inclination so as to extend toward the upper rear side.

A fuel injection valve 115 is attached to the upper part of the throttle body 111. The air cleaner 113 includes an air cleaner case 118 composed of a front case 116 and a rear case 117 based on an anteroposteriorly-split structure, a case intake pipe part 121 provided on the front case 116 in such a manner so as to protrude toward the front side and the obliquely lower side. An air cleaner element 122 is provided at the rear part of the rear case 117. The front end part of the case intake pipe part 121 is connected to the connecting tube 112. An intake-side cover 125 surrounds the air cleaner 113 and is attached to the upper parts of the left and right seat rails 27.

The left-rear-portion exhaust pipe 76 (more specifically, left-rear-portion middle part 76*c*) is disposed below the intake apparatus 47, namely, the throttle body 111 and the connecting tube 112.

A fuel tank 127 supported by the left and right main frames 22 is disposed above the cylinder unit 44. A fuel pump 128 protruding to the inside of the fuel tank 127 is attached to the rear lower part of the fuel tank 127. A fuel supply line 131 is connected to the fuel pump 128 and the fuel injection valve 115 provided at the upper part of the throttle body 111. A heat shield cover 133 blocks heat so that heat of the muffler 52 can be prevented from being transmitted to the side of the intake apparatus 47. A muffler stay 134 is provided for attaching a muffler attachment part 52*b* provided at the upper part of the muffler 52 in order to support the muffler 52 to the sub-frame 28 by a bolt 135.

Figure 6A:
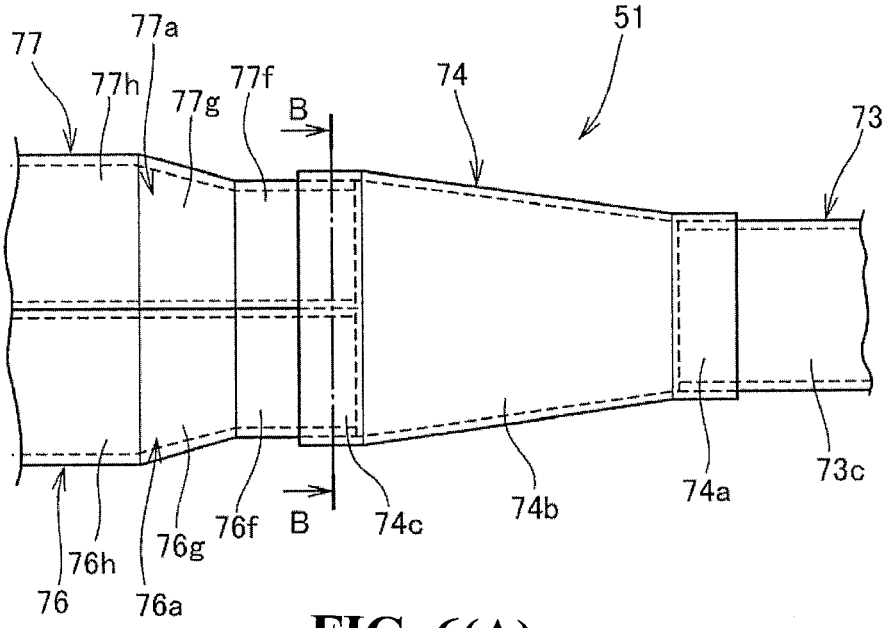
FIGS. 6(A) and 6(B) are explanatory diagrams showing a branching pipe of an exhaust pipe and parts adjacent to the branching pipe.
Figure 6B:
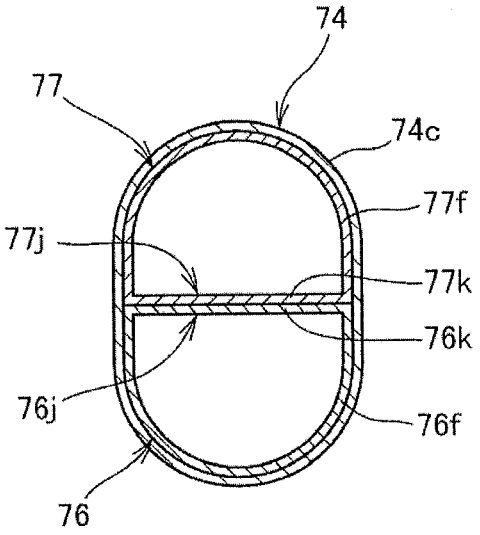

FIGS. 6(A) and 6(B) are explanatory diagrams showing the branching pipe 74 of the exhaust pipe 51 and the parts adjacent to the branching pipe 74. FIG. 6(A) is a diagram showing the connection state of the respective parts of the exhaust pipe 51 and FIG. 6(B) is a sectional view along line B-B in FIG. 6(A).

As shown in FIG. 6(A), the branching pipe 74 is monolithically composed of a front end pipe part 74*a*, a tapered pipe part 74*b*, and a rear end pipe part 74*c* in that order from the upstream side.

The front end pipe part 74*a* is connected by being fitted to the outside of the front-portion rear end part 73*c* of the front-portion exhaust pipe 73. The end surface of the front end pipe part 74*a* is welded to the outer circumferential surface of the front-portion exhaust pipe 73.

The rear end pipe part 74*c* is connected by being fitted to the outside of the left-rear-portion front end part 76*a* of the left-rear-portion exhaust pipe 76 and the right-rear-portion front end part 77*a* of the right-rear-portion exhaust pipe 77. The end surface of the rear end pipe part 74*c* is welded to the respective outer circumferential surfaces of the left-rear-portion front end part 76*a* and the right-rear-portion front end part 77*a*.

The tapered pipe part 74*b* is a part linking the front end pipe part 74*a* and the rear end pipe part 74*c*.

The front end pipe part 74*a* has a circular tubular shape and the rear end pipe part 74*c* has a tubular shape with a section that is an elongated circle. The tapered pipe part 74*b* forms a shape with a diameter that gradually increases in the direction from the front end pipe part 74*a* toward the rear end pipe part 74*c* at least in the direction in which the left-rear-portion exhaust pipe 76 and the right-rear-portion exhaust pipe 77 are juxtaposed.

The left-rear-portion front end part 76*a* of the left-rear-portion exhaust pipe 76 monolithically includes a straight pipe part 76*f*, a tapered pipe part 76*g*, and a pipe part main body 76*h* in that order from the upstream side. Similarly, the right-rear-portion front end part 77*a* of the right-rear-portion exhaust pipe 77 monolithically includes a straight pipe part 77*f*, a tapered pipe part 77*g*, and a pipe part main body 77*h* in that order from the upstream side.

In the left-rear-portion front end part 76*a*, the straight pipe part 76*f* is a part inserted into the rear end pipe part 74*c* of the branching pipe 74. The passage sectional area of the straight pipe part 76*f* is constant in its length direction and the section thereof forms a shape obtained by deforming a circular shape as described later. The tapered pipe part 76*g* is a part whose passage sectional area gradually increases in the direction from the rear end of the straight pipe part 76*f* toward the rear side. The pipe part main body 76*h* is a part linking to the rear end of the tapered pipe part 76*g* and its section forms a circular shape. Also in the right-rear-portion front end part 77*a*, its respective parts form shapes similar to those of the respective parts of the above-described left-rear-portion front end part 76*a*.

As shown in FIG. 6(B), the straight pipe part 76*f* of the left-rear-portion exhaust pipe 76 and the straight pipe part 77*f* of the right-rear-portion exhaust pipe 77 are parts in each of which the section is formed into a semicircular shape obtained by partially deforming a circular shape. They are so welded so as to be fitted to the branching pipe 74, whose section has an elongated circular shape, in a state in which flat bottom walls 76*j* and 77*j* as the bottoms of the semicircles, more specifically bottom surfaces 76*k* and 77*k* of the bottom walls 76*j* and 77*j*, are in contact with each other. The semicircular sections of the straight pipe parts 76*f* and 77*f* each have half of the shape of the elongated circular section.

By forming the section of each of the straight pipe parts 76*f* and 77*f* into the semicircular shape in this manner, the exhaust pipe 51 can be effectively disposed in a motorcycle with a small vehicle body space with suppression of forming of a useless space in the section of the connecting part compared with the case in which two exhaust pipes whose sections each have a circular shape are connected to the branching pipe 74.

Figure 7A:
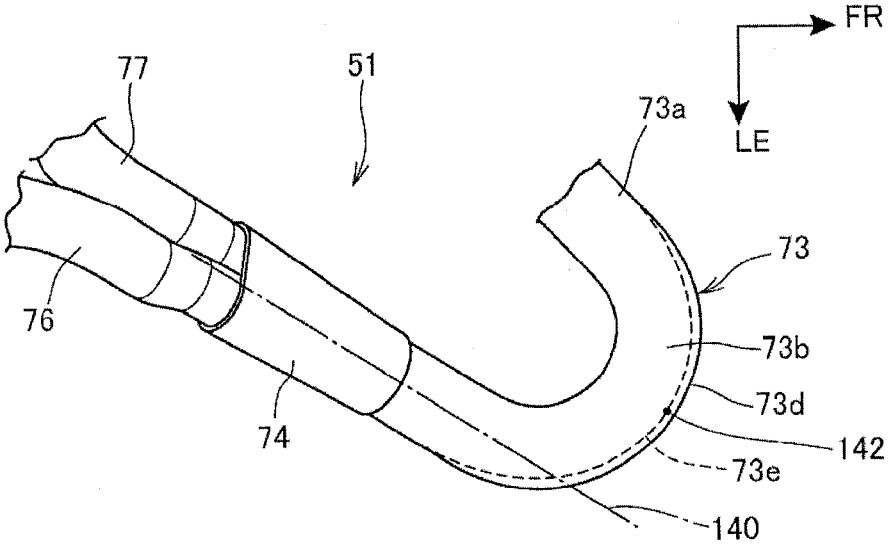
FIGS. 7(A) and 7(B) are explanatory diagrams showing the front part of the exhaust pipe.
Figure 7B:
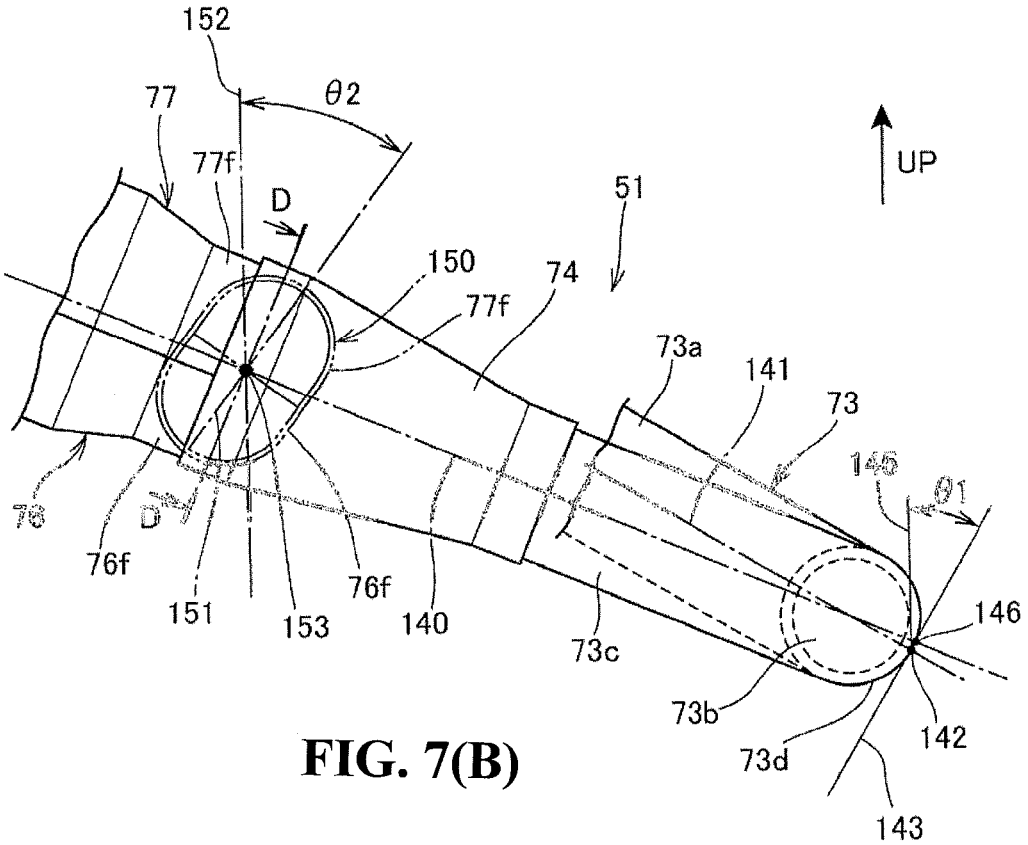

FIGS. 7(A) and 7(B) are explanatory diagrams showing the front part of the exhaust pipe 51. FIG. 7(A) is a plan view and FIG. 7(B) is a diagram as viewed from the direction that is orthogonal to a branching pipe center line 140 and is a horizontal direction.

As shown in FIG. 7(A), the front-portion curving part 73*b* exists at the lowest position in the front-portion exhaust pipe 73 and the height gradually increases as the front-portion exhaust pipe 73 extends from the front-portion curving part 73*b* toward the front-portion front end part 73*a* and toward the branching pipe 74. Therefore, on an outer circumferential surface 73*d* of the front-portion curving part 73*b*, an outer circumferential line 73*e* remotest from the center of curvature of the front-portion curving part 73*b* is shown by a dashed line in the diagram.

As shown in FIG. 7(B), in the front-portion exhaust pipe 73, the front-portion front end part 73*a* is disposed at a higher level than the front-portion rear end part 73*c* and a front end part center line 141 passing through the center of the exhaust passage of the front-portion front end part 73*a* intersects the outer circumferential surface 73*d* at a point (tangent point) 142. When a tangent plane 143 tangent to the outer circumferential surface 73*d* at the point 142 is drawn, the tangent plane 143 is inclined with respect to a vertical line 145 by an angle θ1. The branching pipe center line 140 passing through the center of each of the sections of the front-portion rear end part 73*c* and the branching pipe 74 intersects the outer circumferential surface 73*d* at a point 146.

When a section along line D-D as a cross-section of the straight pipe part 76*f* of the left-rear-portion exhaust pipe 76 and the straight pipe part 77*f* of the right-rear-portion exhaust pipe 77 is drawn so as to overlap with the straight pipe parts 76*f* and 77*f*, a long axis 151 of an elongated circle 150 composed of the sections of the two straight pipe parts 76*f* and 77*f* is inclined with respect to a vertical line 152 by an angle θ2 as shown in the diagram.

In the tangent plane 143, the upper side relative to the point 142 is located closer to the outside in the vehicle width direction than the lower side relative to the point 142. Furthermore, in the long axis 151 of the elongated circle 150, the upper side relative to a center point 153 of the elongated circle 150 is located closer to the outside in the vehicle width direction than the lower side relative to the center point 153.

As above, the tangent plane 143 accords with the long axis 151 in that the upper side is located outside in the vehicle width direction relative to the lower side. In fact, the tangent plane 143 is different from the long axis 151 in the inclination direction. However, when they are drawn with the inclination directions set identical to each other as shown in the diagram, the tangent plane 143 is substantially parallel to the long axis 151 because the angle θ1 is substantially equal to the angle θ2.

As described above, in the front-portion exhaust pipe 73, the inclination angle is larger in the part from the front-portion front end part 73*a* to the front-portion curving part 73*b* than in the part from the front-portion curving part 73*b* to the front-portion rear end part 73*c*. Therefore, exhaust air (exhaust gas) flowing from the front-portion front end part 73*a* to the front-portion curving part 73*b* collects more readily around the point 142 than around the point 146 at the front-portion curving part 73*b* due to the influence of the centrifugal force. Thus, in the front-portion rear end part 73*c* and the branching pipe 74, which are on the downstream side relative to the front-portion curving part 73*b*, the flow of the exhaust air is larger on the lower side relative to the branching pipe center line 140. In view of this, by inclining the elongated circle 150 of the left-rear-portion exhaust pipe 76 and the right-rear-portion exhaust pipe 77 as described above, the position of the straight pipe part 77*f* of the right-rear-portion exhaust pipe 77 located on the upper side is lowered and the position of the straight pipe part 76*f* of the left-rear-portion exhaust pipe 76 is raised. As a result, the flow of the exhaust air into the two straight pipe parts 76*f* and 77*f* can be made more uniform.

As shown in FIGS. 1, 2, and 3, in the exhaust pipe structure of the motorcycle 10 having the engine 14 as an internal combustion engine attached to the vehicle body frame 11, the exhaust pipe 51 that is connected to the exhaust port 14*a* of this engine 14 and is provided with the branching pipe 74 as a branching part that branches into the left-rear-portion exhaust pipe 76 and the right-rear-portion exhaust pipe 77 as two branch exhaust pipes. The mufflers 52 are each connected to a respective one of the left-rear-portion exhaust pipe 76 and the right-rear-portion exhaust pipe 77. The branching pipe 74 is located on a lateral side of the cylinder unit 44 of the engine 14 and above the crankcase cover 65.

According to this configuration, the branching pipe 74 can be disposed closer to the vehicle body front side and near the center of the vehicle body width. This can reduce the degree of bending of the left-rear-portion exhaust pipe 76 and the right-rear-portion exhaust pipe 77 after the branching, which can provide a structure that reduces the airflow resistance to improve the passing of the exhaust air and makes the exhaust air flow into the left-rear-portion exhaust pipe 76 and the right-rear-portion exhaust pipe 77 more uniformly. Accordingly, the exhaust air can be made to flow into the left-rear-portion exhaust pipe 76 and the right-rear-portion exhaust pipe 77 more uniformly and smoothly.

Furthermore, the branching pipe 74 branches in such a manner so that the left-rear-portion exhaust pipe 76 and the right-rear-portion exhaust pipe 77 are substantially juxtaposed in the upward-downward direction. Thus, the branching pipe 74 can be housed in a dead space on a lateral side of the cylinder unit 44 and above the crankcase cover 65. This can reduce the degree of protrusion of the branching pipe 74 in the vehicle width direction.

In addition, as shown in FIGS. 1, 2, 3, 7(A), and 7(B), the exhaust pipe 51 extends from the exhaust port 14*a* toward the front side and the obliquely right side and then curves rearwardly at the front-portion curving part 73*b* as a curving part and branches from the branching pipe 74 at a part further extending toward the rear side and the obliquely left side. The section of the branching pipe 74 is formed into a substantially elongated circular shape and the long axis 151 of the elongated circular shape inclines to be substantially parallel to the tangent plane 143 to the outer circumferential line 73*e* as a curving outer circumferential line passing on the outermost circumference of the front-portion curving part 73*b* of the exhaust pipe 51. Thus, the exhaust air flows with a bias toward the outer circumferential line 73*e*. Therefore, by setting the long axis 151 of the branching pipe 74 substantially parallel to the tangent plane 143 to the outer circumferential line 73*e*, a flow conditioning effect can be achieved in the branching pipe 74 and the exhaust air can be sent from the branching pipe 74 to the left-rear-portion exhaust pipe 76 and the right-rear-portion exhaust pipe 77 more uniformly.

Moreover, as shown in FIGS. 6(A) and 6(B), the outer circumferential parts of the upstream end parts of the left-rear-portion exhaust pipe 76 and the right-rear-portion exhaust pipe 77 are partially deformed to form the bottom surfaces 76*k* and 77*k* as flat surfaces. The left-rear-portion exhaust pipe 76 and the right-rear-portion exhaust pipe 77 are fitted into the branching pipe 74 with these bottom surfaces 76*k* and 77*k* made to overlap with each other. Thus, the part of the bottom surfaces 76*k* and 77*k* plays a role of a flow conditioning plate, which allows the exhaust air to be uniformly distributed into the left-rear-portion exhaust pipe 76 and the right-rear-portion exhaust pipe 77.

Furthermore, as shown in FIG. 3, one of the left-rear-portion exhaust pipe 76 and the right-rear-portion exhaust pipe 77 passes between the pivot plate 23 and the rear shock absorber 91 to extend rearwardly and be connected to one of the mufflers 52. The other of the pipes 76 and 77 passes between the rear side of the cylinder unit 44 and the front side of the rear shock absorber 91 and then passes between the other pivot plate 23 and the rear shock absorber 91 to extend rearwardly and be connected to the other of the mufflers 52. Thus, the bending of the left-rear-portion exhaust pipe 76 and the right-rear-portion exhaust pipe 77 is reduced and these pipes are made linear. This can reduce the airflow resistance and improve the passing of the exhaust air.

In addition, as shown in FIGS. 2 and 3, the left-rear-portion exhaust pipe 76 and the right-rear-portion exhaust pipe 77 have the first bending part 76*b*, the second bending part 76*d*, and the bending part 77*b* as at least one bending part in a space that is on the rear side of the cylinder unit 44, on the front side of the rear shock absorber 91, above the crankcase 43, and below the intake apparatus 47 as an intake system. Therefore, the length of the exhaust pipe can be adjusted by providing the first bending part 76*b*, the second bending part 76*d*, and the bending part 77*b* by utilizing a dead space. Thus, the flexibility in the design of the engine 14 can be increased.

Moreover, the branching pipe 74 and the parts connected to the front and rear of the branching pipe 74 in the exhaust pipe 51 are formed into the linear part 93 having a linear shape and this linear part 93 extends along the upper surface 65*a* of the crankcase cover 65 in side view. Thus, the length across which air in the exhaust passage is conditioned can be ensured by the linear part 93 and the exhaust air that has passed in the branching pipe 74 can be made to uniformly flow into the left-rear-portion exhaust pipe 76 and the right-rear-portion exhaust pipe 77. Furthermore, by disposing the linear part 93 along the upper surface 65*a* of the crankcase cover 65, a space above the crankcase cover 65 can be efficiently used.

The above-described embodiment is one mode of the present invention and modification and application can be arbitrarily made without departing from the gist of the present invention.

Furthermore, the present invention is not limited to the case of applying it to the motorcycle 10 and can be applied also to saddle-type vehicles including vehicles other than motorcycles. The saddle-type vehicles are vehicles that include overall vehicles ridden with the vehicle body straddled and include not only motorcycles (including motorized bicycles) but also three-wheeled vehicles and four-wheeled vehicles categorized as ATV (all terrain vehicle).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust pipe structure for a motorcycle having an internal combustion engine which comprises:

an exhaust pipe having an elongated circular shape and connected to an exhaust port of the internal combustion engine, said exhaust pipe including a branching part that branches into two branch exhaust pipes; and a muffler connected to each of the branch exhaust pipes;

said branching part being located on a lateral side of a cylinder unit of the internal combustion engine and above a crankcase cover and branching rearwardly into said branch exhaust pipes which have circular shaped upstream end portions, the circular shape of the upstream end portions of the exhaust pipes being partially deformed to form flat walls which are in contact with each other, whereby vehicle body space is effectively enhanced.

2. The exhaust pipe structure for use with a motorcycle according to claim 1, further providing that the branching part and parts connected to the front and to the rear of the branching part, in the exhaust pipe, are formed into a linear part having a linear shape and this linear part extends along an upper surface of the crankcase cover, in a side view.

3. The exhaust pipe structure for use with a motorcycle according to claim 1, further providing that the exhaust pipe extends from the exhaust port toward a front side of the motorcycle and then curves rearwardly from the branching part to the branch exhaust pipes; and a section of the branching part is formed into an elongated circular shape, with a long axis of the elongated circular shape inclined to be parallel to a tangent plane to a curving outer circumferential line passing on an outermost circumference of the curving part of the exhaust pipe.

4. The exhaust pipe structure for use with a motorcycle according to claim 3, further providing that one of the branch exhaust pipes passes between a pivot plate and a rear shock absorber to extend rearwardly to be connected to one of the mufflers, and the other of the branch exhaust pipes passes between a rear side of the cylinder unit and a front side of the rear shock absorber and then passes between another pivot plate and the rear shock absorber to extend rearwardly and be connected to the other of the mufflers.

5. The exhaust pipe structure for use with a motorcycle according to claim 1, further providing that one of the branch exhaust pipes passes between a pivot plate and a rear shock absorber to extend rearwardly to be connected to one of the mufflers, and the other of the branch exhaust pipes passes between a rear side of the cylinder unit and a front side of the rear shock absorber and then passes between another pivot plate and the rear shock absorber to extend rearwardly and be connected to the other of the mufflers.

6. The exhaust pipe structure for use with a motorcycle according to claim 5, further providing that the branch exhaust pipes have at least one bending part in a space that is on the rear side of the cylinder unit, on the front side of the rear shock absorber, above a crankcase, and below an intake system.

7. The exhaust pipe structure for use with a motorcycle according to claim 1, further providing that the branching part branches in such a manner that the two branch exhaust pipes are juxtaposed in an upward-downward direction.

8. The exhaust pipe structure for use with a motorcycle according to claim 7, further providing that the exhaust pipe extends from the exhaust port toward a front side of the motorcycle and then curves rearwardly from the branching part to the branch exhaust pipes; and a section of the branching part is formed into an elongated circular shape, with a long axis of the elongated circular shape inclined to be parallel to a tangent plane to a curving outer circumferential line passing on an outermost circumference of the curving part of the exhaust pipe.

9. The exhaust pipe structure for use with a motorcycle according to claim 7, further providing that one of the branch exhaust pipes passes between a pivot plate and a rear shock absorber to extend rearwardly to be connected to one of the mufflers, and the other of the branch exhaust pipes passes between a rear side of the cylinder unit and a front side of the rear shock absorber and then passes between another pivot plate and the rear shock absorber to extend rearwardly and be connected to the other of the mufflers.

10. An exhaust pipe structure for a motorcycle having an internal combustion engine attached to a vehicle body frame, comprising:

an exhaust pipe connected to an exhaust port of the internal combustion engine and provided with a branching part located on a lateral side of a cylinder unit of the internal combustion engine and above a crankcase cover, that branches rearwardly into left rear portion and right rear portion exhaust pipes provided with respective mufflers, the exhaust pipe extending from the exhaust port toward a front side of the motorcycle and then curving rearwardly to form said branching part which branches rearwardly into said left rear portion exhaust pipe and said right rear portion exhaust pipe, upstream end portions of the left rear portion and right rear portion exhaust pipes being partially deformed to form flat walls which are in contact with each other, and the branching part comprising an elongated circular shape with a long axis of the elongated circular shape being inclined to be parallel to a tangent plane to a curving outer circumferential line passing on an outermost circumference of the curving part of the exhaust pipe.

11. The exhaust pipe structure for a motorcycle according to claim 10, further providing that the branching part and parts connected to the front and to the rear of the branching part, in the exhaust pipe, are formed into a linear part having a linear shape and this linear part extends along an upper surface of the crankcase cover, in a side view.

12. The exhaust pipe structure for a motorcycle according to claim 10, further providing that one of the left rear portion and right rear portion exhaust pipes passes between a pivot plate and a rear shock absorber to extend rearwardly to be connected to one of the mufflers, and the other of the left rear portion and right rear portion exhaust pipes passes between a rear side of the cylinder unit and a front side of the rear shock absorber and then passes between another pivot plate and the rear shock absorber to extend rearwardly and be connected to the other of the mufflers.

13. The exhaust pipe structure for a motorcycle according to claim 12, further providing that the left rear portion and right rear portion exhaust pipes have at least one bending part in a space that is on the rear side of the cylinder unit, on the front side of the rear shock absorber, above a crankcase, and below an intake system.

14. The exhaust pipe structure for a motorcycle according to claim 10, further comprising that the branching part branches in such a manner that the left rear portion and right rear portion exhaust pipes are juxtaposed in an upward-downward direction.

15. The exhaust pipe structure for a motorcycle according to claim 14, further providing that one of the left rear portion and right rear portion exhaust pipes passes between a pivot plate and a rear shock absorber to extend rearwardly to be connected to one of the mufflers, and the other of the left rear portion and right rear portion exhaust pipes passes between a rear side of the cylinder unit and a front side of the rear shock absorber and then passes between another pivot plate and the rear shock absorber to extend rearwardly and be connected to the other of the mufflers.

16. The exhaust pipe structure for a motorcycle according to claim 14, further providing that the branching part and parts connected to the front and to the rear of the branching part, in the exhaust pipe, are formed into a linear part having a linear shape and this linear part extends along an upper surface of the crankcase cover, in a side view.

* * * * *